US009043201B2

(12) United States Patent
Mittal et al.

(10) Patent No.: US 9,043,201 B2
(45) Date of Patent: May 26, 2015

(54) METHOD AND APPARATUS FOR PROCESSING AUDIO FRAMES TO TRANSITION BETWEEN DIFFERENT CODECS

(75) Inventors: Udar Mittal, Hoffman Estates, IL (US); James P. Ashley, Naperville, IL (US)

(73) Assignee: GOOGLE TECHNOLOGY HOLDINGS LLC, Mountain View, CA (US)

( * ) Notice: Subject to any disclaimer, the term of this patent is extended or adjusted under 35 U.S.C. 154(b) by 482 days.

(21) Appl. No.: 13/342,462

(22) Filed: Jan. 3, 2012

(65) Prior Publication Data

US 2013/0173259 A1 Jul. 4, 2013

(51) Int. Cl.

| | |
|---|---|
| ***G10L 21/00*** | (2013.01) |
| ***G10L 19/02*** | (2013.01) |
| ***G10L 19/12*** | (2013.01) |
| ***G10L 19/18*** | (2013.01) |

(52) U.S. Cl.

CPC ..... *G10L 19/0212* (2013.01); *G10L 19/12* (2013.01); *G10L 19/18* (2013.01)

(58) Field of Classification Search

USPC ..... 704/201, 500–504

See application file for complete search history.

(56) References Cited

U.S. PATENT DOCUMENTS

| | | | | |
|---|---|---|---|---|
| 2003/0009325 | A1 * | 1/2003 | Kirchherr et al. | 704/211 |
| 2005/0159942 | A1 | 7/2005 | Singhal | |
| 2006/0173675 | A1 | 8/2006 | Ojanpera | |
| 2009/0319263 | A1 * | 12/2009 | Gupta et al. | 704/229 |
| 2011/0173008 | A1 | 7/2011 | Lecomte et al. | |
| 2011/0173010 | A1 * | 7/2011 | Lecomte et al. | 704/500 |
| 2011/0218797 | A1 | 9/2011 | Mittal et al. | |

(Continued)

FOREIGN PATENT DOCUMENTS

| | | | |
|---|---|---|---|
| CN | 102105930 | A | 6/2011 |
| EP | 2144230 | A1 | 1/2010 |

(Continued)

OTHER PUBLICATIONS

Third Generation Partnership Project (3GPP), "3rd Generation Partnership Project; Technical Specification Group Services and System Aspects; Audio Codec Processing Functions; Extended Adaptive Multi-Rate—Wideband (AMR-WB+) Codec; Transcoding Functions (Release 10)", 3GPP TS 26.290 V10.0.0, Mar. 2011, 85 pages.

(Continued)

*Primary Examiner* — Leonard Saint Cyr

(74) *Attorney, Agent, or Firm* — Birch, Stewart, Kolasch & Birch, LLP

(57) ABSTRACT

A method (700, 800) and apparatus (100, 200) processes audio frames to transition between different codecs. The method can include producing (720), using a first coding method, a first frame of coded output audio samples by coding a first audio frame in a sequence of frames. The method can include forming (730) an overlap-add portion of the first frame using the first coding method. The method can include generating (740) a combination first frame of coded audio samples based on combining the first frame of coded output audio samples with the overlap-add portion of the first frame. The method can include initializing (760) a state of a second coding method based on the combination first frame of coded audio samples. The method can include constructing (770) an output signal based on the initialized state of the second coding method.

22 Claims, 9 Drawing Sheets

(56) References Cited

U.S. PATENT DOCUMENTS

| | | | | |
|---|---|---|---|---|
| 2011/0218799 | A1 | 9/2011 | Mittal et al. | |
| 2011/0238425 | A1* | 9/2011 | Neuendorf et al. | 704/500 |
| 2011/0320212 | A1 | 12/2011 | Tsujino et al. | |
| 2012/0087504 | A1* | 4/2012 | Thumpudi et al. | 381/23 |

FOREIGN PATENT DOCUMENTS

| | | | |
|---|---|---|---|
| EP | 2144231 | A1 | 1/2010 |
| EP | 2214164 | A2 | 8/2010 |
| WO | 2010003564 | A1 | 1/2010 |
| WO | 2010003663 | A1 | 1/2010 |

OTHER PUBLICATIONS

Pierre Combescure et al., "A 16, 24, 32 KBIT/S Wideband Speech Codec Based on ATCELP", IEEE Int'l Conf. on Acoustics, Speech, and Signal Processing Proc., Mar. 15-19, 1999, pp. 5-8, vol. 1.

Third Generation Partnership Project 2 (3GPP2), "Enhanced Variable Rate Codec, Speech Service Options 3, 68, 70, and 73 for Wideband Spread Spectrum Digital Systems", 3GPP2 v3.0, Oct. 2010, 318 pages.

Jeremie Lecomte et al., "Efficient cross-fade windows for transitions betweeen LPC-based and non-LPC based audio coding", Audio Engineering Society Convention Paper 7712, May 7-10, 2009, 9 pages.

Andreas S. Spanias, "Speech Coding: A Tutorial Review", Proc. of the IEEE, Oct. 1994, pp. 1539-1582, vol. 82 No. 10.

Ted Painter and Andreas Spanias, "Perceptual Coding of Digital Audio", Proc. of the IEEE, Apr. 2000, pp. 451-513, vol. 88 No. 4.

Udar Mittal et al., "Method and Apparatus for Audio Coding and Dedcoding", U.S. Appl. No. 13/190,517, filed Jul. 26, 2011, 34 pages.

Patent Cooperation Treaty, "PCT Search Report and Written Opinion of the International Searching Authority" for International Application No. PCT/US2012/047806, Oct. 26, 2012, 15 pages.

Chinese Office Action for corresponding Chinese application No. 201310001449.5 dated Nov. 24, 2014.

Balazs Kovesi et al., "Integration of a CELP Coder in the ARDOR Universal Sound Codec," Interspeech 2006, ICSLP Ninth International Conference on Spoken Language Processing, Pittsburgh, PA, Sep. 17, 2006, XP008100900.

European Search Report for corresponding EP Application No. 12198717.6, dated Jan. 7, 2015.

Max Neuendorf, et al., "Completion of Core Experiment on unification of USAC Windowing and Frame Transitions", 91.MPEG Meeting; Kyoto, (Motion Picture Expert Group or ISO/IEC JTC1/SC29/WG11) No. M17167, Jan. 16, 2010., XP030045757.

* cited by examiner

METHOD AND APPARATUS FOR PROCESSING AUDIO FRAMES TO TRANSITION BETWEEN DIFFERENT CODECS

CROSS-REFERENCE TO RELATED APPLICATIONS

This application is related to application Ser. No. 13/190,517 entitled "Method and Apparatus for Audio Coding and Decoding," Motorola case number CS38538, filed on Jul. 26, 2011, and commonly assigned to the assignee of the present application, and which is hereby incorporated by reference.

BACKGROUND

1. Field

The present disclosure is directed to a method and apparatus for processing audio frames to transition between different codecs. More particularly, the present disclosure is directed to state updating when switching between two coding modes for audio frames.

2. Introduction

Communication devices used in today's society include mobile phones, personal digital assistants, portable computers, desktop computers, gaming devices, tablets, and various other electronic communication devices. Many of these devices transmit audio signals between each other. Codecs are used to encode and decode the audio signals for transmission between the devices. Some audio signals are classified as speech signals having more speech-like characteristics typical of the spoken word. Other audio signals are classified as generic audio signals having more generic audio characteristics typical of music, tones, background noise, reverberant speech, and other generic audio characteristics.

Speech codecs based on source-filter models that are suitable for processing speech signals do not process generic audio signals effectively. The speech codecs include Linear Predictive Coding (LPC) codecs, such as Code Excited Linear Prediction (CELP) codecs. Speech codecs tend to process speech signals well even at low bit rates. Conversely, generic audio processing codecs, such as frequency domain transform codecs, do not process speech signals as efficiently. To process both speech and generic audio signals, a classifier or discriminator determines, on a frame-by-frame basis, whether an audio signal is more or less speech-like and directs the signal to either a speech codec or a generic audio codec based on the classification. An audio signal processor capable of such processing of both speech and generic audio signals is sometimes referred to as a hybrid codec. In some cases the hybrid codec may be a variable rate codec. For example, it may code different types of frames at different rates. As a further example, the generic audio frames, which are coded using the transform domain, are coded at higher rates as opposed to the speech-like frames, which are coded at lower rates.

Transitioning between the processing of speech frames and generic audio frames using speech and generic audio modes, respectively, produces discontinuities. For example, the transition from a speech audio CELP domain frame to a generic audio transform domain frame has been shown to produce discontinuity in the form of an audio gap. The transition from the transform domain to the CELP domain also results in audible discontinuities which adversely affect the audio quality. A major reason for the discontinuity is improper initialization of the various states of the CELP codec. Some of the states which have an adverse effect on the quality include an LPC Synthesis filter state and an Adaptive Codebook (ACB) excitation state.

To circumvent this issue of state update, prior art codecs, such as Extended Adaptive Multi-Rate-Wideband (AM-RWB+) and Enhanced Variable Rate Codec-Wideband (EVRC-WB) use LPC analysis even in the audio mode and code the residual in the transform domain. The synthesized output is thus generated by passing the time domain residual obtained using the inverse transform through an LPC synthesis filter. That process by itself generates the LPC synthesis filter state and the ACB excitation state. However, the generic audio signals typically do not conform to the LPC model. Therefore, bits spent on the LPC quantization may result in loss of performance for the generic audio signals.

Thus, there is an opportunity for a method and apparatus for processing audio frames to transition between different codecs.

BRIEF DESCRIPTION OF THE DRAWINGS

In order to describe the manner in which advantages and features of the disclosure can be obtained, various embodiments will be illustrated in the appended drawings. Understanding that these drawings depict only typical embodiments of the disclosure and do not limit its scope, the disclosure will be described and explained with additional specificity and detail through the use of the drawings in which.

DETAILED DESCRIPTION

When transitioning a stream of audio frames between different codecs, often the stream needs to change from one digital sampling rate (so that a first codec can process a first frame) to another digital sampling rate (so that a second codec can process a next frame). This resampling may cause a time delay that can be heard as a slight "hitch" or "pause" in the audio output. Additionally, switching codecs mid-stream in a stream of audio frames may create audio output artifacts, such as clicks or pops, if the second codec is not properly initialized. The methods and apparatuses described below seek to reduce audio output disturbances by using a combination frame when switching between audio codecs. This combination frame may compensate for time delays caused by resampling and may initialize the second codec to reduce audio output artifacts that might be caused by the audio codecs switching.

For example, embodiments can improve audio quality during transitions between generic audio and speech codecs by proper initialization of Code Excited Linear Prediction (CELP) codec states in a frame that follows a transform domain frame. While some embodiments can address a situation where the transform domain part is purely transform domain and does not use a Linear Predictive Coding (LPC) analysis and synthesis, embodiments can be used even if the codec uses LPC analysis or synthesis or other analysis or synthesis. Also, embodiments can provide for improved audio-to-speech transition. While a speech-to-audio transition can have different nuances, elements of embodiments may also be used to provide for other improved transitions, such as speech-to-speech transitions where the two different speech modes use different types of filters and/or different sampling rates.

A method and apparatus processes audio frames to transition between different codecs. The method can include producing, using a first coding method, a first frame of coded output audio samples by coding a first audio frame in a sequence of frames. The coded output audio samples can be sampled at a first sampling rate. The method can include forming an overlap-add portion of the first frame using the first coding method. The method can include generating a combination first frame of coded audio samples based on combining the first frame of coded output audio samples with the overlap-add portion of the first frame. The method can include initializing a state of a second coding method based on the combination first frame of coded audio samples. The method can include constructing an output signal based on the initialized state of the second coding method.

Figure 1:
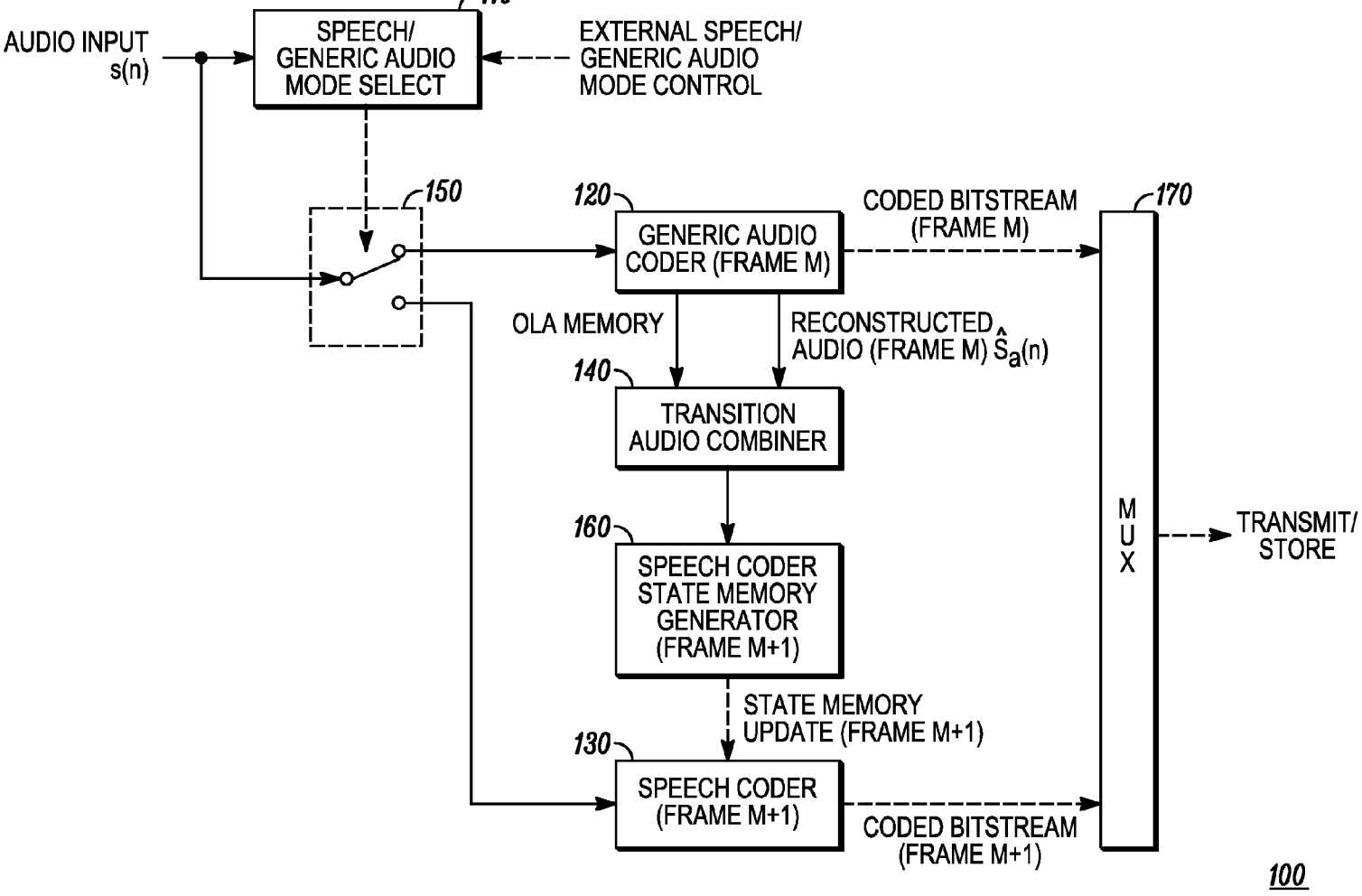
FIG. 1 is an example block diagram of a hybrid coder according to a possible embodiment.

FIG. 1 is an example block diagram of a hybrid coder 100 according to a possible embodiment. The hybrid coder 100 can code an input stream of frames, where some of the frames can be speech frames and other frames can be generic audio frames. The generic audio frames can include elements other than speech, can be less speech-like, and/or can include non-speech elements. The hybrid coder 100 can be incorporated into any electronic device performing encoding and decoding of audio. Such devices can include cellular telephones, music players, home telephones, personal digital assistants, laptop computers, and other devices that can process both speech audio frames and generic audio frames.

The hybrid coder 100 can include a mode selector 110 that can process frames of an input audio signal s(n), where n can be the sample index. The mode selector 110 can receive an external speech and generic audio mode control signal and select a generic audio or speech codec according to the control signal. The mode selector 110 can also get input from a rate determiner (not shown) which can determine a bit rate for a current frame. For example, a frame of the input audio signal can include 320 samples of audio when the sampling rate is 16 kHz samples per second, which can correspond to a frame time interval of 20 milliseconds, although many other variations are possible. The bit rate of a current frame can control the type of encoding method used between a speech coding method and a generic audio coding method. The bit rate may also influence the internal sampling rate, i.e., higher bit rates may facilitate coding higher audio bandwidths, while lower bit rates may be more limited to coding lower bandwidths. Thus, a codec that is capable of supporting a wide range of bit rates may also support a range of audio bandwidths and sampling frequencies, each of which may be switchable on a frame-by-frame basis.

The hybrid coder 100 can include a first coder 120 that can code generic audio frames, such as a coded bitstream for frame m, and can include a second coder 130 that can code speech frames, such as a coded bitstream for frame m+1. For example, the second coder 130 can be a speech coder 130 based on a source-filter model suitable for processing speech signals. The first coder 120 can be a generic audio coder 120 that can use a linear orthogonal lapped transform based on Time Domain Aliasing Cancellation (TDAC). As a further example, the speech coder 130 can use an LPC typical of a CELP coder, among other coders suitable for processing speech signals. The generic audio coder 120 can be implemented as Modified Discrete Cosine Transform (MDCT) coder, a Modified Discrete Sine Transform (MSCT) coder, forms of the MDCT based on different types of Discrete Cosine Transform (DCT), DCT/Discrete Sine Transform (DST) combinations, or other generic audio coding formats.

The first and second coders 120 and 130 can have inputs coupled to the input audio signal s(n) by a selection switch 150 that can be controlled based on the mode determined by the mode selector 110. For example, the switch 150 may be controlled by a processor based on a codeword output from the mode selector 110. The switch 150 can select the speech coder 130 for processing speech frames and can select the generic audio coder 120 for processing generic audio frames. While only two coders are shown in the hybrid coder 100, the frames may be coded by several different types of coders. For example, one of three or more coders may be selected to process a particular frame of the input audio signal.

Each of the first and second coder 120 and 130 can produce an encoded bit stream and can produce a corresponding processed frame based on the corresponding input audio frame processed by the corresponding coder. The encoded bit stream can then be stored via a multiplexer 170 or can be transmitted via the multiplexer 170.

An audio discontinuity may occur when transitioning from the generic audio coder 120 to the speech coder 130. The hybrid coder 100 can include a speech coder state memory generator 160 that can address the discontinuity issue. For example, states based on parameters, such as filter parameters, can be used by the speech coder 130 to encode a frame of speech. The speech coder state memory generator 160 can process a preceding generic audio frame to generate the states for the speech coder 130 for a transition between generic audio and speech. As mentioned above, when transitioning a stream of audio frames between different codecs, often the stream needs to change from one digital sampling rate to another digital sampling rate. This sampling rate change may cause a time delay that can be heard as a slight "hitch" or "pause" in the audio output. Additionally, switching codecs mid-stream in a stream of audio frames may create audio output artifacts, such as clicks or pops, if the second codec is not properly initialized. The speech coder state memory generator 160 can reduce audio output disturbances by processing a preceding generic audio frame to generate states for the speech coder 130. This can compensate for time delays caused by resampling and can reduce audio output artifacts that might be caused by the switch between codecs.

According to one embodiment, the first coder 120 can produce, using a first coding method, a first frame of coded output audio samples by coding a first audio frame in a sequence of frames. For example, the coded output audio samples can be reconstructed audio $\hat{s}_a(n)$ for a frame m. The coded output audio samples can be sampled at a first sampling rate. The first coder 120 can form an overlap-add portion in the form of Overlap-Add (OLA) memory of the first frame using the first coding method. The overlap-add portion can be generated by decomposing a signal into simple components, processing each of the components, and recombining the processed components into the final signal. The overlap-add portion can be based on evaluating a discrete convolution of a very long signal with a finite impulse response filter. For example, an overlap-add delay can correspond to a modified discrete cosine transform synthesis memory portion of a frame generated by a generic audio coder (or a generic audio decoder). The time-length of the overlap-add portion in general can depend on a MDCT window used for coding. The MDCT window may be chosen based on the projected resampling delay. Also, the desired codec design can determine how the MDCT window is chosen.

The hybrid coder 100 can include a transition audio combiner 140. The transition audio combiner 140 can generate a combination first frame of coded audio samples based on combining the first frame of coded output audio samples with the overlap-add portion of the first frame. The combination first frame of coded audio samples can be used when transitioning from the first coding method to the second coding method. The transition audio combiner 140 can generate the combination first frame of coded audio samples based on appending the overlap-add portion of the first frame to the first frame of coded output audio samples. The transition audio combiner 140 can also generate the resampled combination first frame of coded audio samples by resampling the combination first frame of coded audio samples at a second sampling rate.

The speech coder state memory generator 160 can be a second coder state generator that can initialize a state of a second coding method based on the combination first frame of coded audio samples. The second coder state memory generator 160 can initialize a state of a second coding method, such as a speech coding method, by outputting a state memory update for a frame m+1 based on the resampled combination first frame of coded audio samples.

The second coder 130 can construct an output signal based on the initialized state of the second coding method and the next audio input frame (m+1). If the second coder 130 is a speech coder, the second coder 130 can construct a coded speech signal based on the initialized state of the speech coding method and the next audio input frame (m+1). Thus, if the first coder 120 is a generic audio coder and the second coder 130 is a speech coder, a first output frame can be a TDAC-coded signal and a next output frame can be a CELP-coded signal. Conversely, if the first coder 120 is a speech coder and the second coder 130 is a generic audio coder, a first output frame can be a CELP-coded signal followed by a next output frame with a TDAC-coded signal. When the coding changes mid-stream (i.e., from one frame to the next frame), the hybrid coder 100 can reduce delay and audio artifacts that may be caused by switching coders.

Figure 2:
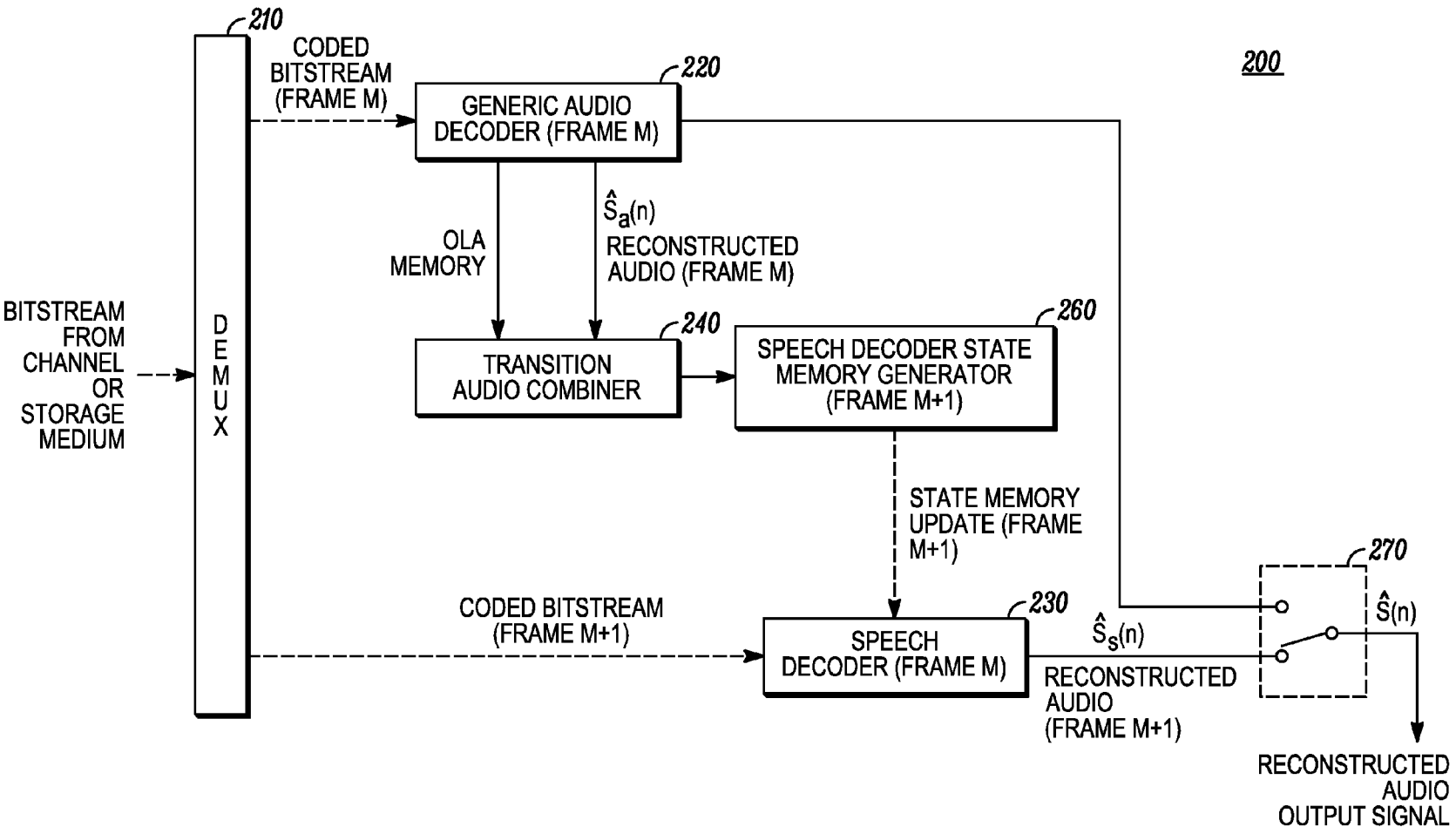
FIG. 2 is an example block diagram of a hybrid decoder according to a possible embodiment.

FIG. 2 is an example block diagram of a hybrid decoder 200 according to a possible embodiment. The hybrid decoder 200 can include a demultiplexer 210 that can receive a coded bitstream from a channel or a storage medium and can pass the bitstream to an appropriate decoder. The hybrid decoder 200 can include a generic audio decoder 220 that can receive frames of the coded bitstream, such as for a frame m, from a channel or storage medium. The generic audio decoder 220 can decode generic audio and can generate a reconstructed generic audio output frame $\hat{s}_a(n)$. The hybrid decoder 200 can include a speech decoder 230 that can receive frames of the coded bitstream, such as for a frame m+1. The speech decoder 230 can decode speech audio and can generate a reconstructed speech audio output frame $\hat{s}_s(n)$, such as for frame m+1. The hybrid decoder 200 can include a switch 270 that can select the reconstructed generic audio output frame $\hat{s}_a(n)$ or the reconstructed speech audio output frame $\hat{s}_s(n)$ to output a reconstructed audio output signal.

Audio discontinuity may occur when transitioning from the generic audio decoder 220 to the speech decoder 230. The hybrid decoder 200 can include a speech decoder state memory generator 260 that can address the discontinuity issue. For example, states based on parameters, such as filter parameters, can be used by the speech decoder 230 to decode a frame of speech. The speech decoder state memory generator 260 can process a preceding generic audio frame from the generic audio decoder 220 to generate the states for the speech decoder 230 for a transition between generic audio and speech.

The hybrid decoder 200 can include a transition audio combiner 240. The transition audio combiner 240 can generate a combination first frame of coded audio samples based on combining the first frame of coded output audio samples with an overlap-add portion of the first frame. The transition audio combiner 240 can generate the combination first frame of coded audio samples to transition from the first coding method to the second coding method. The transition audio combiner 240 can generate the combination first frame of coded audio samples based on appending the overlap-add portion of the first frame to the first frame of coded output audio samples.

More generally, the hybrid decoder 200 can be an apparatus for processing audio frames. The generic audio decoder 220 can be a first decoder 220 configured to produce, using a first decoding method, a first frame of decoded output audio samples by decoding a bitstream frame (frame m) in a sequence of frames. The decoded output audio samples can be sampled at the first sampling rate. The first decoder 220 can be configured to form an overlap-add portion of the first frame using a first decoding method.

The transition audio combiner 240 can generate a combination first frame of decoded audio samples based on combining the first frame of decoded output audio samples with the overlap-add portion of the first frame. The combination first frame of decoded audio samples can be used when transitioning from the first decoding method to the second decoding method. The transition audio combiner 240 can generate the combination first frame of decoded audio samples based on appending the overlap-add portion of the first frame to the first frame of decoded output audio samples. The transition audio combiner 240 can also generate the combination first frame of decoded audio samples by resampling the combination first frame of decoded audio samples at a second sampling rate to generate a resampled combination first frame of decoded audio samples.

The second decoder state memory generator 260 can initialize a state of a second decoding method, such as a speech decoding method, based on the combination first frame of decoded audio samples from 240. For example, the second decoder state memory generator 260 can initialize a state of a second decoding method based on a resampled combination first frame of decoded audio samples.

The speech decoder 230 can construct an output signal based on the initialized state of the second coding method and the next coded bitstream input frame (m+1). For example, the speech decoder 230 can construct an audible speech signal based on the initialized state of the speech decoding method. Continuing the example, one coded bitstream input frame m can be decoded using the generic audio decoder 220 and the subsequent coded bitstream input frame m+1 can be decoded using the initialized speech decoder 230 to produce a smooth audible audio signal with reduced or eliminated pauses, clicks, pops, or other artifacts.

Figure 3:
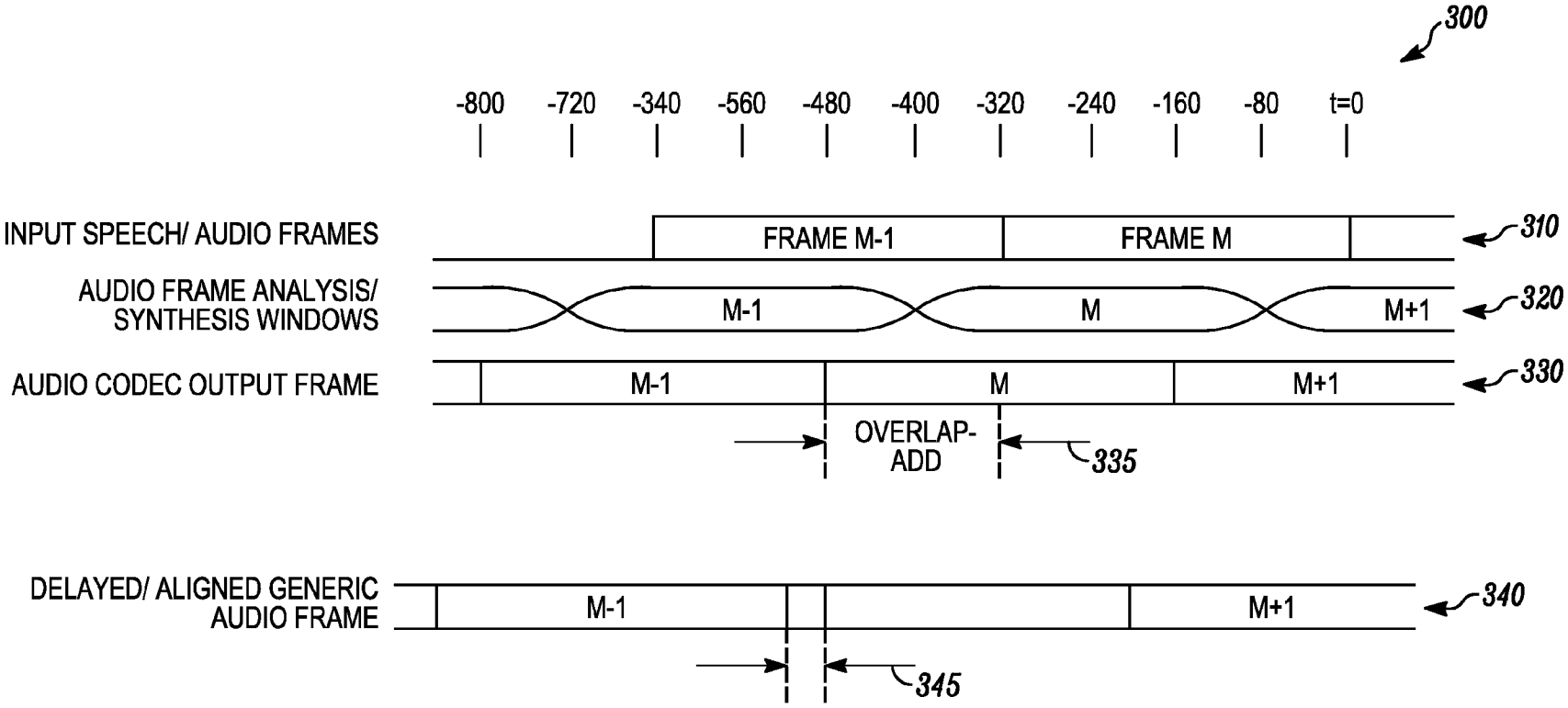
FIG. 3 is an example illustration of relative frame timing between an audio core and a speech core according to a possible embodiment.

FIG. 3 is an example illustration of relative frame timing 300 between an audio core and a speech core according to a possible embodiment. The frame timing 300 can include timing between input speech and audio frames 310, audio frame analysis and synthesis windows 320, audio codec output frames 330, and delayed and aligned generic audio frames 340. Corresponding frames have an index of m. The frame timing 300 can align to a given time t. The delay of the audio codec output frame 330 from the input speech and audio frames 310 can correspond to an overlap-add delay 335. The overlap-add delay 335 can correspond to a modified discrete cosine transform synthesis memory portion of a frame, such as frame m−1, generated by a generic audio coder, such as the generic audio coder 120, or a generic audio decoder, such as the generic audio decoder 220. For example, the overlap-add delay 335 of a frame m−1 can be generated using a coding method or generated using a decoding method. The delayed and aligned generic audio frame m−1 of delayed and aligned generic audio frames 340 can be a combination frame of coded audio samples generated based on combining the frame of coded output audio samples, such as a frame m of the audio code output frames 330, with an overlap-add portion of the overlap-add delay 335 of the frame m−1 to remove or eliminate a delay 345 caused by a resampling filter.

Figure 4:
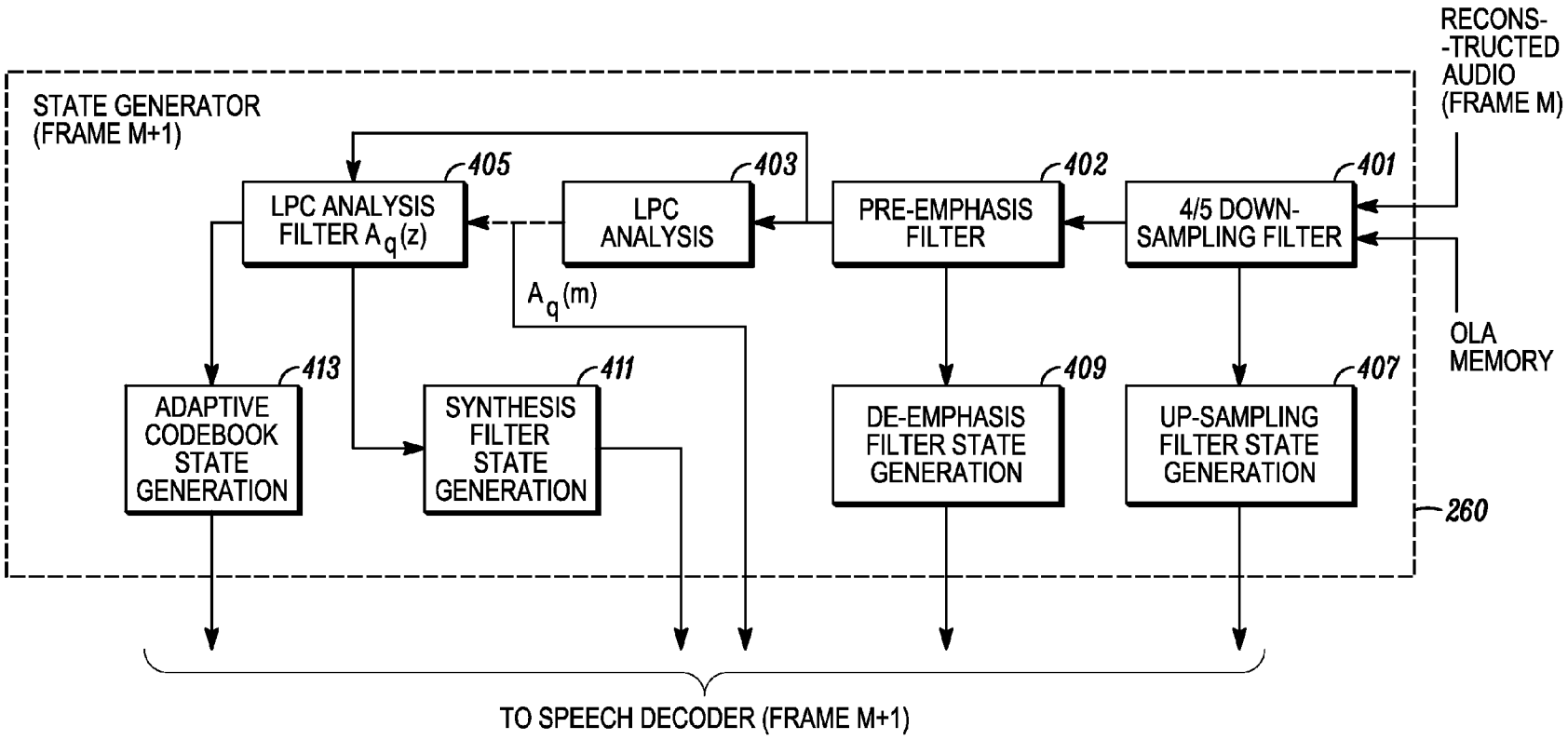
FIG. 4 is an example block diagram of a state generator according to a possible embodiment.

FIG. 4 is an example block diagram of a state generator 260 according to a possible embodiment. If the second decoder is a speech decoder, the state generator 260 may generate initial states such as: an up-sampling filter state, a de-emphasis filter state, a synthesizer filter state, and an adaptive codebook state. The state generator 260 can generate the state of a speech decoder, such as the speech decoder 230, for a frame m+1 based on a previous frame m. The state generator 260 can include a 4/5 downsampling filter 401, an up-sampling filter state generation block 407, a pre-emphasis filter 402, a de-emphasis filter state generation block 409, a LPC analysis block 403, an LPC analysis filter 405, a synthesis filter state generation block 411, and an adaptive codebook state generation block 413.

The downsampling filter 401 can receive and downsample a reconstructed audio frame, such as frame m, and can receive and downsample corresponding Overlap-Add (OLA) memory data. Other downsampling filters may be 4/10, 1/2, 4/15, or 1/3 downsampling filters, depending on the sampling frequencies used by the two coding methods. The upsampling filter state generation block 407 can determine and output a state for a speech decoder up-sampling filter at the second decoder 230 based on the downsampled frame and OLA memory data from 401. The pre-emphasis filter 402, coupled to the output of 401, can perform pre-emphasis on the reconstructed downsampled audio. The de-emphasis filter state generation block 409 can determine and output a state for a respective speech decoder de-emphasis filter based on the pre-emphasized audio from 402. The LPC analysis block 403 can perform LPC on the pre-emphasized audio from 402 and output the result to the second decoder 230.

The LPC analysis filter $A_q(z)$ 405 can filter the pre-emphasis filter 402 output, optionally using the LPC analysis block 403 output which is $A_q(m)$. The synthesis filter state generation block 411 can determine and output a state for the respective speech decoder synthesis filter based on the output of the LPC analysis filter 405. The adaptive codebook state generation block 413 can generate a state for the respective speech decoder adaptive codebook based on the output of the LPC analysis filter 405.

Figure 5:
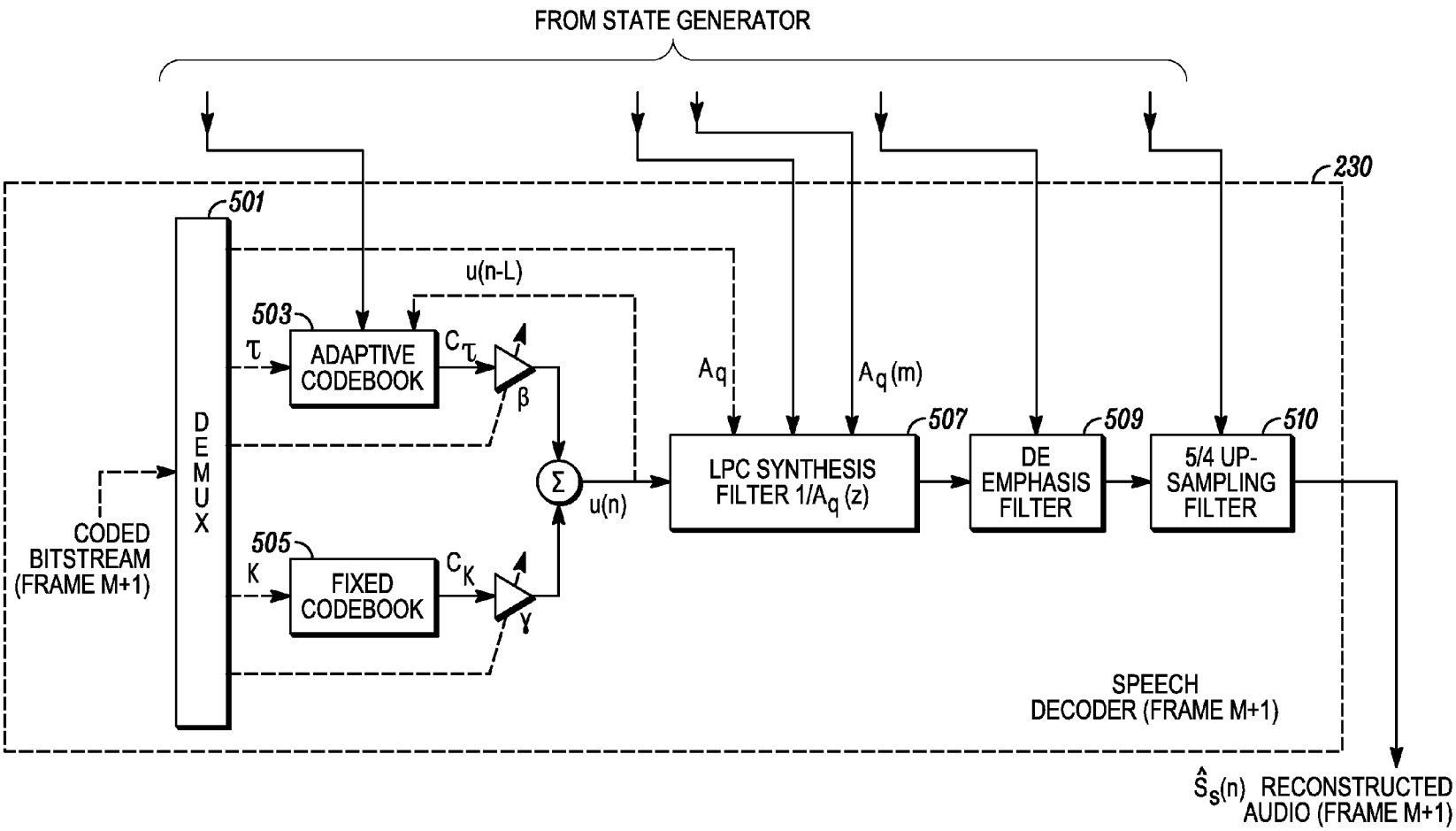
FIG. 5 is an example block diagram of a decoder according to a possible embodiment.

FIG. 5 is an example block diagram of the decoder 230 according to a possible embodiment. The decoder 230 can be initialized with the state information from the state generator 260. The decoder 230 can include a demultiplexer 501, an adaptive codebook 503, a fixed codebook 505, an LPC synthesis filter 507, such as a Code Excited Linear Predication (CELP) filter, a de-emphasis filter 509, and a 5/4 upsampling filter 511. The demultiplexer 501 can demultiplex a coded bitstream and can use the adaptive codebook 503 and the fixed codebook 505 and an optimal set of codebook-related parameters, such as $A_q$, $\tau$, $\beta$, k, and $\gamma$, to generate a signal u(n) from the coded bitstream to reconstruct a speech audio signal $\hat{s}_s(n)$. The LPC synthesis filter 507 can generate a synthesized signal based on the signal u(n). The de-emphasis filter 509 can de-emphasize the output of the synthesis filter 507, and the de-emphasized signal can be passed through a, for example, 12.8 kHz to 16 kHz upsampling filter 510. Other upsampling filters may be used, such as 4/10, 1/2, 4/15, or 1/3 upsampling filters, depending on the sampling frequencies used by the two coding methods.

According to one embodiment, a speech decoder state memory generator, such as the generator 260, can generate state memories to be used by the speech decoder 230 for decoding a subsequent frame of speech during a transition from generic audio coding to speech coding by processing a generic audio frame output by various filters. The parameters for the filters may be same as in the corresponding speech encoder or may be complimentary or inverse of the filters used in the speech decoder. For example, the filter state generator 407 can provide down-sampling filter state memory to the filter 510. The filter state generator 409 can provide pre-emphasis filter state memory to the filter 509. The LPC analysis block 403 and the synthesis filter state generator 411 can provide linear prediction coefficients for the LPC filter 507. The adaptive codebook state generation block 413 can provide the adaptive codebook state memory to the adaptive codebook 503. Also, other parameters and state memory can be provided from the state generator 260 to the speech decoder 230.

Thus, blocks of the decoder 230 can be initialized with the state information from blocks of the state generator 260. This initialization can reduce audio output disturbances by using a combination frame when switching between audio codecs. This combination frame may compensate for time delays caused by resampling and may initialize the second codec to reduce audio output artifacts that might be caused by the audio codecs switching. Blocks of the speech decoder state memory generator 260 can process a combination of a preceding generic audio frame along with overlap-add memory from the generic audio decoder 220 to generate the states for the speech decoder 230 for a transition between generic audio and speech.

Figure 6:
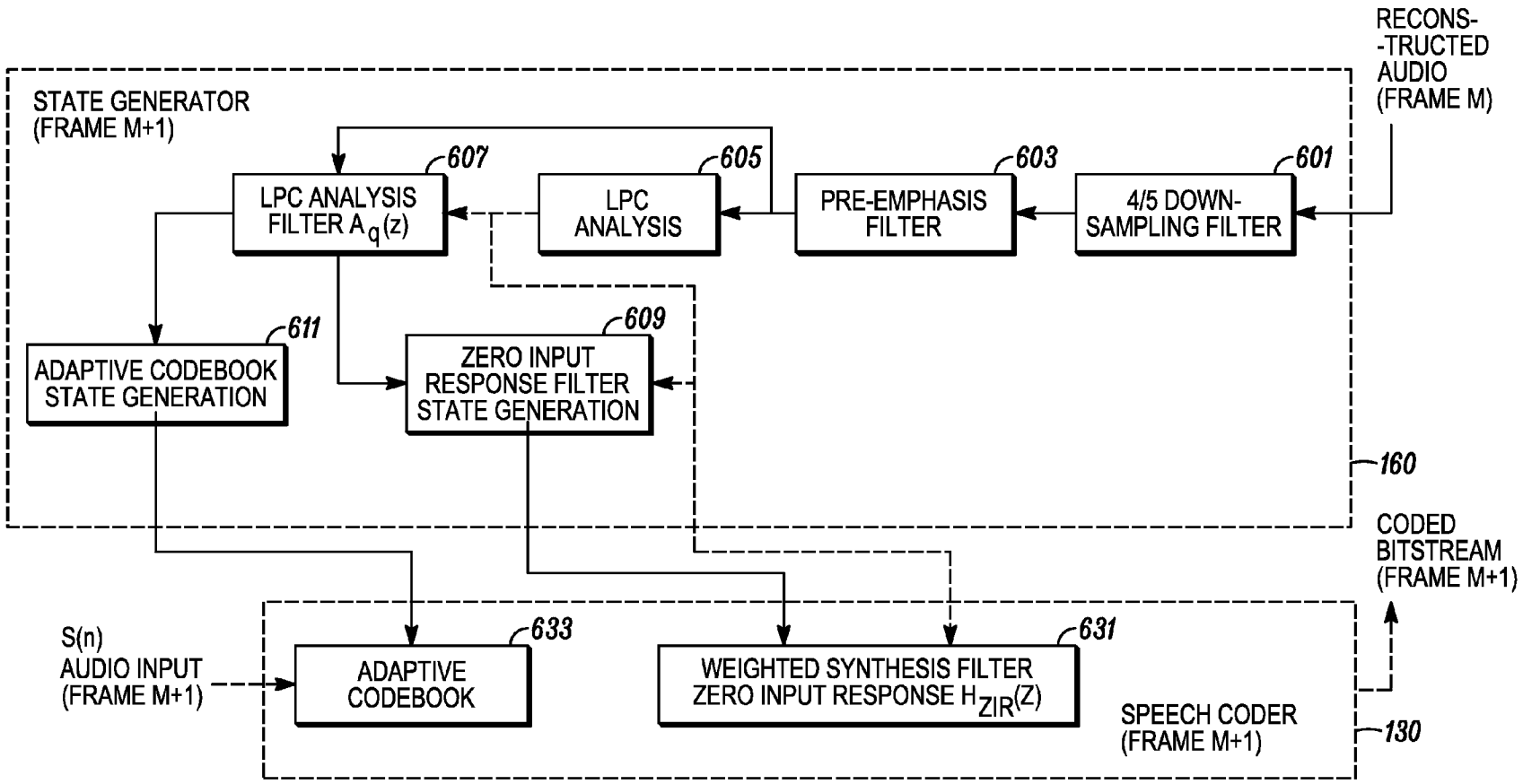
FIG. 6 is an example block diagram of a speech encoder state memory generator and a speech coder according to a possible embodiment.

FIG. 6 is an example block diagram of the speech encoder state memory generator 160 and the speech coder 130 according to a possible embodiment. The speech encoder state memory generator 160 can include a 4/5 downsampling filter 601. The speech encoder state memory generator 160 can include a pre-emphasis filter 603 coupled to the output of the downsampling filter 601. The speech encoder state memory generator 160 can include an LPC analysis filter 605 coupled to the output of the pre-emphasis filter 603. The speech encoder state memory generator 160 can include an LPC analysis filter $A_q(z)$ block 607 coupled to the output of the LPC analysis filter 605 and coupled to the output of the pre-emphasis filter 603. The speech encoder state memory generator 160 can include a zero input response filter state generation block 609 coupled to the output of the LPC analysis filter 607 and/or coupled to the output of the LPC analysis filter 605. The speech encoder state memory generator 160 can include an adaptive codebook state generation block 611 coupled to the output of the LPC analysis filter 607.

The speech coder 130 can include an adaptive codebook 633 and a weighted synthesis filter zero input response filter $H_{zir}(z)$. The speech encoder state memory generator 160 can initialize the speech coder 130 with initialization states. For example, the zero input response filter state generation block 609 and the LPC analysis block 605 can provide an initialization state and/or parameters for the weighted synthesis filter zero input response block 631. Also, the adaptive codebook state generation block 611 can provide an initialization state and/or parameters for the adaptive codebook 633. The speech encoder state memory generator 160 can also initialize the speech coder 130 with other initialization states and parameters.

Figure 7:
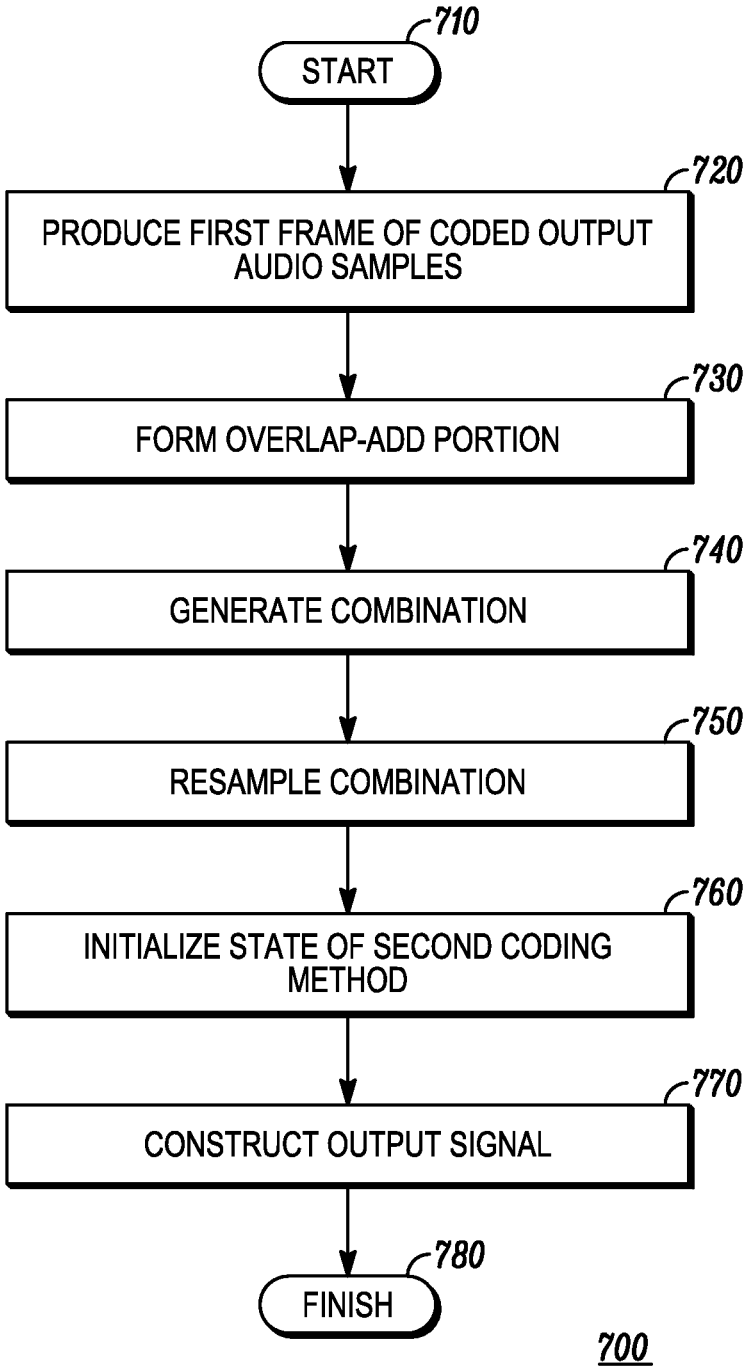
FIG. 7 illustrates an example flowchart illustrating the operation of a communication device according to a possible embodiment.

FIG. 7 illustrates an example flowchart 700 illustrating the operation of a communication device, such as a device including the hybrid coder 100, according to a possible embodiment. At 710, the flowchart can begin.

At 720, a first frame of coded output audio samples can be produced using a first coding method by coding a first audio frame in a sequence of frames. The coded output audio samples can be sampled at a first sampling rate. The first frame of coded output audio samples can be produced using a generic audio coding method by coding a first audio frame in a sequence of frames where the coded output audio samples can be sampled at the first sampling rate.

At 730, an overlap-add portion of the first frame can be formed using the first coding method. The overlap-add portion of the first frame can be a modified discrete cosine transform synthesis memory portion of the first frame.

At 740, a combination first frame of coded audio samples can be generated based on combining the first frame of coded output audio samples with the overlap-add portion of the first frame. The combination first frame of coded audio samples can be generated based on appending the overlap-add portion of the first frame to the first frame of coded output audio samples. The combination first frame can also be generated based on appending a scaled overlap-add portion of the first frame to the first frame of coded output audio samples. The combination first frame of coded audio samples can be generated to compensate for a delay from resampling the combination first frame of coded audio samples at the second sampling rate.

At 750, the combination first frame of coded audio samples can be resampled at a second sampling rate to generate a resampled combination first frame of coded audio samples. The combination first frame of coded audio samples can be resampled by downsampling the combination first frame of coded audio samples at a second sampling rate to generate a downsampled combination first frame of coded audio samples.

At 760, a state of a second coding method can be initialized based on the combination first frame of coded audio samples. The state of the second coding method can also be initialized based on the resampled combination first frame of coded audio samples. The state of the second coding method can also be initialized by initializing the state of a resampling filter and/or a state of a speech coding method based on the resampled combination first frame of coded audio samples.

At 770, an output signal can be constructed based on the initialized state of the second coding method and the audio input signal. The output signal can be constructed by constructing an audible speech signal based on the initialized state of the speech coding method. The output signal can also be constructed by constructing an output signal for a second frame following the first frame based on the initialized state of the second coding method. The output signal can also be constructed by constructing a coded bit stream based on the initialized state of the second coding method and the audio input signal.

At 780, the flowchart 700 can end. According to some embodiments, all of the blocks of the flowchart 700 are not necessary. Additionally, the flowchart 700 or blocks of the flowchart 700 may be performed numerous times, such as iteratively. For example, the flowchart 700 may loop back from later blocks to earlier blocks. Furthermore, many of the blocks can be performed concurrently or in parallel processes.

Figure 8:
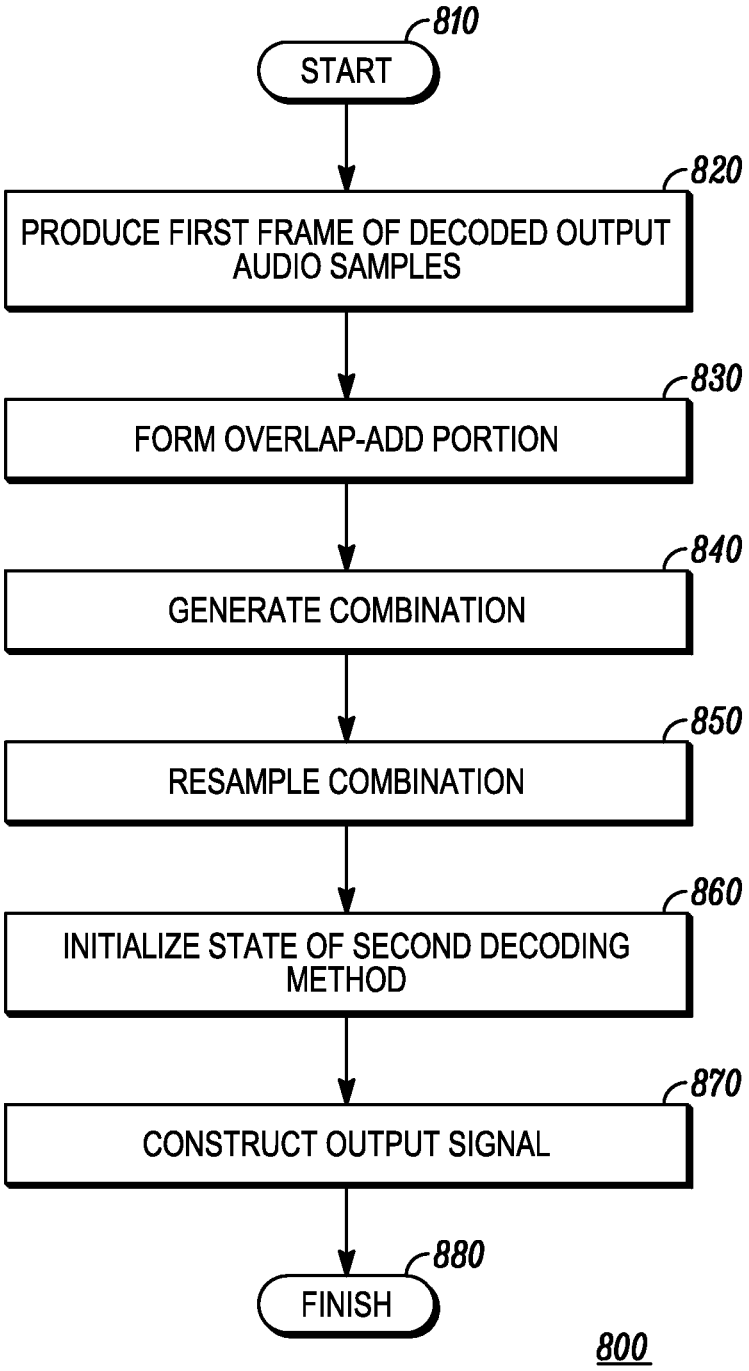
FIG. 8 illustrates an example flowchart illustrating the operation of a communication device according to a possible embodiment.

FIG. 8 illustrates an example flowchart 800 illustrating the operation of a communication device, such as a device including the hybrid decoder 200, according to a possible embodiment. At 810, the flowchart can begin.

At 820, a first frame of decoded output audio samples can be produced using a first decoding method by decoding a bitstream frame in a sequence of frames. The decoded output audio samples can be sampled at a first sampling rate.

At 830, an overlap-add portion of the first frame can be formed using the first decoding method. The overlap-add portion of the first frame can be a modified discrete cosine transform synthesis memory portion of the first frame.

At 840, a combination first frame of decoded audio samples can be generated based on combining the first frame of decoded output audio samples with the overlap-add portion of the first frame. The combination first frame of decoded audio samples can be generated to compensate for a time delay created when resampling the combination first frame of decoded audio samples at the second sampling rate. The combination first frame of decoded audio samples can be generated based on appending the overlap-add portion of the first frame to the first frame of decoded output audio samples. The combination first frame of decoded audio samples can also be generated based on appending a scaled overlap-add portion of the first frame to the first frame of decoded output audio samples.

At 850, the combination first frame of decoded audio samples can be resampled at a second sampling rate to generate a resampled combination first frame of decoded audio samples. The combination first frame of decoded audio samples can be resampled by downsampling the combination first frame of decoded audio samples at the second sampling rate to generate a downsampled combination first frame of decoded audio samples.

At 860, a state of a second decoding method can be initialized based on the combination or the resampled combination first frame of decoded audio samples. The state of a second decoding method can be initialized by initializing a state of a speech decoding method based on the combination first frame of decoded audio samples, such as based on the downsampled combination first frame of decoded audio samples.

At 870, an output signal can be constructed based on the initialized state of the second coding method, such as a speech coding method, and the audio input signal s(n+1). For example, the output signal can be constructed from a reconstructed audio frame for a second frame following the first frame based on the initialized state of the second decoding method.

At 880, the flowchart 800 can end. According to some embodiments, all of the blocks of the flowchart 800 are not necessary. Additionally, the flowchart 800 or blocks of the flowchart 800 may be performed numerous times, such as iteratively. For example, the flowchart 800 may loop back from later blocks to earlier blocks. Furthermore, many of the blocks can be performed concurrently or in parallel processes.

Figure 9:
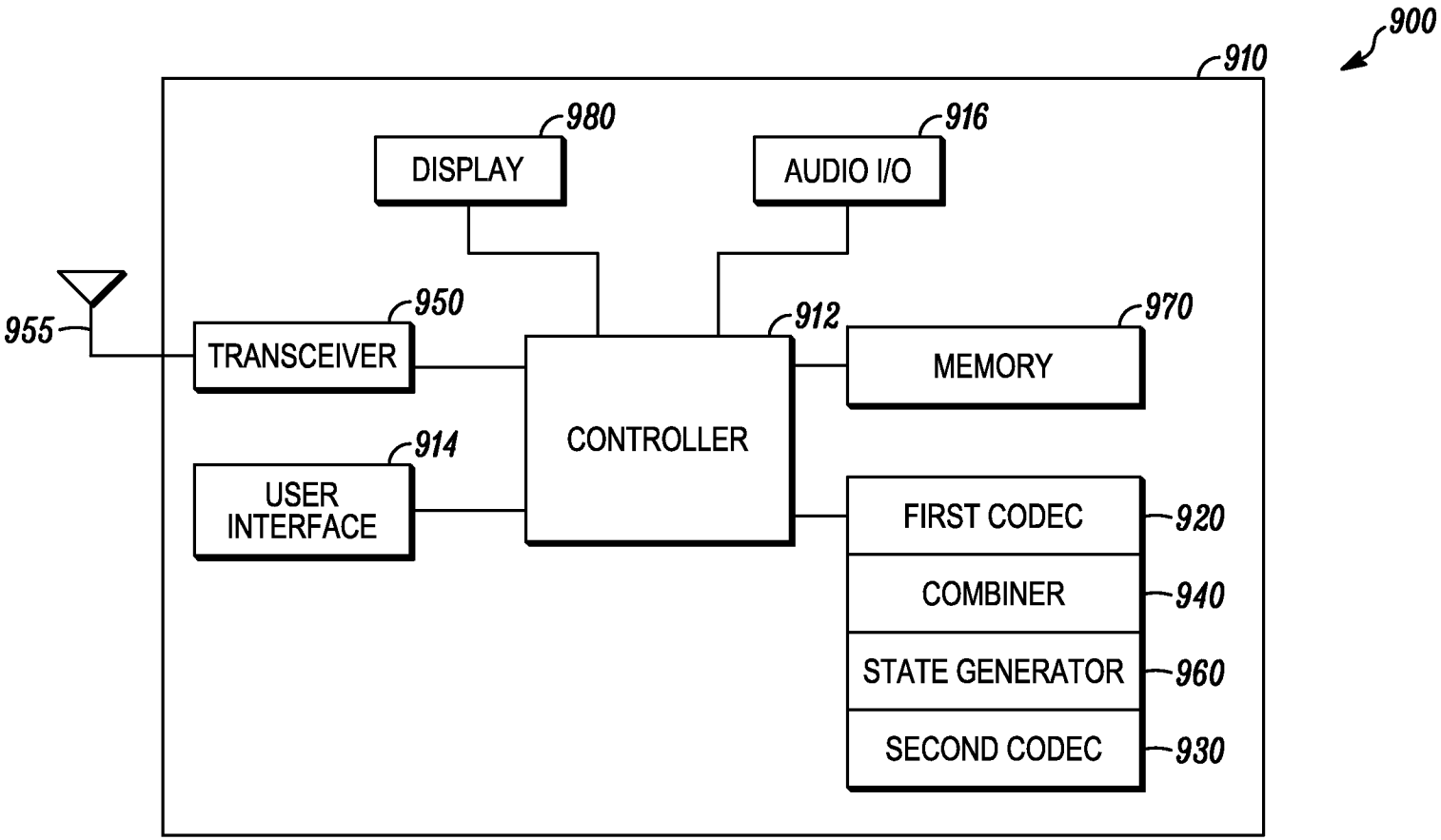
FIG. 9 is an example block diagram of a communication device according to a possible embodiment.

FIG. 9 is an example block diagram of a communication device 900 according to a possible embodiment. The communication device 900 can include a housing 910, a controller 912 located within the housing 910, audio input and output circuitry 916 coupled to the controller 912, a display 980 coupled to the controller 912, a transceiver 950 coupled to the controller 912, an antenna 955 coupled to the transceiver 950, other user interface 914 components coupled to the controller 912, and a memory 970 coupled to the controller 912.

The communication device 900 can also include a first codec 920, a combiner 940, a state generator 960, and a second codec 930. The first codec 920 can be a coder, a decoder, or a combination coder and decoder. The second codec 930 can be a coder, a decoder, or a combination coder and decoder. The first codec 920, the combiner 940, the state generator 960, and/or the second codec 930 can be coupled to the controller 912, can reside within the controller 912, can reside within the memory 970, can be autonomous modules, can be software, can be hardware, or can be in any other format useful for a module for a communication device 900. The first codec 920 can perform the operations of the generic audio coder 120 and/or the generic audio decoder 220. The combiner 940 can perform the functions of the transition audio combiner 140 and/or the transition audio combiner 240. The state generator 960 can perform the functions of the speech coder state memory generator 160 and/or the speech decoder state memory generator 260. The second codec 930 can perform the functions of the speech encoder 130 and/or the speech decoder 230.

The display 980 can be a liquid crystal display (LCD), a light emitting diode (LED) display, a plasma display, a touch screen display, a projector, or any other means for displaying information. Other methods can be used to present information to a user, such as aurally through a speaker or kinesthetically through a vibrator. The transceiver 950 may include a transmitter and/or a receiver and can transmit wired and/or wireless communication signals. The audio input and output circuitry 916 can include a microphone, a speaker, a transducer, or any other audio input and output circuitry. The user interface 914 can include a keypad, buttons, a touch pad, a joystick, an additional display, a touch screen display, or any other device useful for providing an interface between a user and an electronic device. The memory 970 can include a random access memory, a read only memory, an optical memory, a subscriber identity module memory, flash memory, or any other memory that can be coupled to a communication device.

The user interface 914, the audio input output circuitry 916, and/or the transceiver 950 can create an output signal constructed based on an initialized state of a second coding or decoding method, such as by the second codec 930. Also, or alternately, the memory 970 can store the output signal constructed based on the initialized state of the second coding or decoding method.

The methods of this disclosure may be implemented on a programmed processor. However, the operations of the embodiments may also be implemented on non-transitory machine readable storage having stored thereon a computer program having a plurality of code sections that include the blocks illustrated in the flowcharts, or a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the operations of the embodiments may be used to implement the processor functions of this disclosure.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the disclosed embodiments. For example, one of ordinary skill in the art of the disclosed embodiments would be enabled to make and use the teachings of the disclosure by simply employing the elements of the independent claims. Accordingly, the embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. The term "coupled," unless otherwise modified, implies that elements may be connected together, but does not require a direct connection. For example, elements may be connected through one or more intervening elements. Furthermore, two elements may be coupled by using physical connections between the elements, by using electrical signals between the elements, by using radio frequency signals between the elements, by using optical signals between the elements, by providing functional interaction between the elements, or by otherwise relating two elements together. Also, relational terms, such as "top," "bottom," "front," "back," "horizontal," "vertical," and the like may be used solely to distinguish a spatial orientation of elements relative to each other and without necessarily implying a spatial orientation relative to any other physical coordinate system. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. A method for processing audio frames comprising:

producing, using a first coding method, a first frame of coded output audio samples by coding a first audio frame in a sequence of frames wherein the coded output audio samples are sampled at a first sampling rate;

forming an overlap-add portion of the first frame using the first coding method;

generating a combination first frame of coded audio samples based on combining the first frame of coded output audio samples with the overlap-add portion of the first frame;

initializing a state of a second coding method based on the combination first frame of coded audio samples; and constructing an output signal based on the initialized state of the second coding method, wherein the generating a combination first frame comprises:

resampling the combination first frame of coded audio samples at a second sampling rate to generate a resampled combination first frame of coded audio samples, wherein the initializing comprises initializing the state of the second coding method based on the resampled combination first frame of coded audio samples.

2. The method according to claim 1, wherein the initializing comprises:

initializing the state of at least a resampling filter of the second coding method based on the resampled combination first frame of coded audio samples.

3. The method according to claim 1, wherein the combination first frame of coded audio samples is generated based on combining the first frame of coded output audio samples with the overlap-add portion of the first frame to compensate for a delay from resampling the combination first frame of coded audio samples at the second sampling rate.

4. The method according to claim 1, wherein the overlap-add portion of the first frame comprises a modified discrete cosine transform synthesis memory portion of the first frame.

5. The method according to claim 1, wherein the first coding method is a generic audio coding method, and the second coding method is a speech coding method.

6. The method according to claim 5, wherein the resampling includes downsampling the combination first frame of coded audio samples at the second sampling rate to generate a downsampled combination first frame of coded audio samples, wherein the initializing comprises initializing the state of the speech coding method based on the downsampled combination first frame of coded audio samples.

7. The method according to claim 1, wherein the generating a combination first frame comprises:

generating the combination first frame of coded audio samples based on appending the overlap-add portion of the first frame to the first frame of coded output audio samples.

8. The method according to claim 1, wherein the constructing an output signal comprises:

constructing the output signal for a second frame following the first frame based on the initialized state of the second coding method.

9. A method for processing audio frames comprising:

producing, using a first decoding method, a first frame of decoded output audio samples by decoding a bitstream frame in a sequence of frames wherein the decoded output audio samples are sampled at a first sampling rate;

forming an overlap-add portion of the first frame using the first decoding method;

generating a combination first frame of decoded audio samples based on combining the first frame of decoded output audio samples with the overlap-add portion of the first frame;

initializing a state of a second decoding method based on the combination first frame of decoded audio samples; and constructing an output signal based on the initialized state of the second decoding method, wherein the generating a combination first frame comprises:

resampling the combination first frame of decoded audio samples at a second sampling rate to generate a resampled combination first frame of decoded audio samples, wherein the initializing comprises initializing the state of the second decoding method based on the resampled combination first frame of decoded audio samples.

10. The method according to claim 9, wherein the initializing comprises:

initializing the state of at least a resampling filter of the second decoding method based on the resampled combination first frame of decoded audio samples.

11. The method according to claim 9, wherein the combination first frame of decoded audio samples is generated based on combining the first frame of decoded output audio samples with the overlap-add portion of the first frame to compensate for a delay from resampling the combination first frame of decoded audio samples at the second sampling rate.

12. The method according to claim 9, wherein the overlap-add portion of the first frame comprises a modified discrete cosine transform synthesis memory portion of the first frame.

13. The method according to claim 9, wherein the first decoding method is a generic audio decoding method, the second decoding method is a speech decoding method, and the output signal is an audible speech signal.

14. The method according to claim 13, wherein the resampling includes:

downsampling the combination first frame of decoded audio samples at the second sampling rate to generate a downsampled combination first frame of decoded audio samples, wherein initializing comprises initializing the state of the speech decoding method based on the downsampled combination first frame of decoded audio samples.

15. The method according to claim 9, wherein the generating a combination first frame comprises:

generating the combination first frame of decoded audio samples based on appending the overlap-add portion of the first frame to the first frame of decoded output audio samples.

16. The method according to claim 9, wherein the constructing an output signal comprises:

constructing the output signal for a second frame following the first frame based on the initialized state of the second decoding method.

17. An apparatus for processing audio frames comprising:

a processor and a memory device, said memory device configured to store instructions that, when executed by the processor, cause the processor to be configured to:

produce, using a first coding method, a first frame of coded output audio samples by coding a first audio frame in a sequence of frames wherein the coded output audio samples are sampled at a first sampling rate, the first coding method also configured to form an overlap-add portion of the first frame;

generate a combination first frame of coded audio samples based on combining the first frame of coded output audio samples with the overlap-add portion of the first frame;

initialize a state of a second coding method based on the combination first frame of coded audio samples; and construct an output signal based on the initialized state of the second coding method, the generating a combination first frame including resampling the combination first frame of coded audio samples at a second sampling rate to generate a resampled combination first frame of coded audio samples, wherein the initializing a state of a second coding method initializing the state of the second coding method based on the resampled combination first frame of coded audio samples.

18. The apparatus according to claim 17, wherein the first coding method is a generic audio coding method, and the second coding method is a speech coding method.

19. The apparatus according to claim 17, wherein the generating a combination first frame including generating the combination first frame of coded audio samples based on appending the overlap-add portion of the first frame to the first frame of coded output audio samples.

20. An apparatus for processing audio frames comprising:

a processor and a memory device, said memory device configured to store instructions that, when executed by the processor, cause the processor to be configured to:

produce, using a first decoding method, a first frame of decoded output audio samples by decoding a bitstream frame in a sequence of frames wherein the decoded output audio samples are sampled at a first sampling rate, the first decoding method also configured to form an overlap-add portion of the first frame;

generate a combination first frame of decoded audio samples based on combining the first frame of decoded output audio samples with the overlap-add portion of the first frame;

initialize a state of a second decoding method based on the combination first frame of decoded audio samples; and construct an output signal based on the initialized state of the second decoding method, the generating a combination first frame including resampling the combination first frame of decoded audio samples at a second sampling rate to generate a resampled combination first frame of decoded audio samples, wherein the initializing a state of a second coding method initializing the state of the second decoding method based on the resampled combination first frame of decoded audio samples.

21. The apparatus according to claim 20, wherein the first decoding method is a generic audio decoding method, the second decoding method is a speech decoding method, and the output signal is an audible speech signal.

22. The apparatus according to claim 20, wherein the generating a combination first frame including generating the combination first frame of decoded audio samples based on appending the overlap-add portion of the first frame to the first frame of decoded output audio samples.

* * * * *